US007556575B2

(12) United States Patent
Lammer et al.

(10) Patent No.: US 7,556,575 B2
(45) Date of Patent: Jul. 7, 2009

(54) DAMPENING DEVICE FOR A BALL GAMES RACKET

(75) Inventors: Herfried Lammer, Lauterach (AT); Jürgen Wilke, Wolfurt (AT)

(73) Assignee: Head Technology GmbH, Kennelbach (AT)

( * ) Notice: Subject to any disclaimer, the term of this patent is extended or adjusted under 35 U.S.C. 154(b) by 87 days.

(21) Appl. No.: 10/523,520

(22) PCT Filed: Jul. 24, 2003

(86) PCT No.: PCT/EP03/08176

§ 371 (c)(1), (2), (4) Date: Nov. 21, 2005

(87) PCT Pub. No.: WO2004/020048

PCT Pub. Date: Mar. 11, 2004

(65) Prior Publication Data

US 2006/0135296 A1 Jun. 22, 2006

(30) Foreign Application Priority Data

Aug. 9, 2002 (DE) ..... 102 36 633

(51) Int. Cl.
*A63B 51/00* (2006.01)

(52) U.S. Cl. ..... 473/522

(58) Field of Classification Search ..... 473/520–522, 473/553, 537

See application file for complete search history.

(56) References Cited

U.S. PATENT DOCUMENTS

| | | | | |
|---|---|---|---|---|
| 4,180,265 | A | 12/1979 | Staufer | |
| 4,190,249 | A | 2/1980 | Fischer | |
| 4,575,083 | A | 3/1986 | Adam | |
| 4,732,383 | A | 3/1988 | Ferrari et al. | |
| 4,776,590 | A | 10/1988 | Krent et al. | |
| 4,911,445 | A * | 3/1990 | Ferrari et al. | 473/522 |
| 5,096,194 | A * | 3/1992 | Yong et al. | 473/522 |
| 5,106,086 | A | 4/1992 | Acosta | |
| 5,149,090 | A * | 9/1992 | Chen et al. | 473/522 |
| 5,350,173 | A * | 9/1994 | DiCerbo | 473/521 |
| 5,398,928 | A * | 3/1995 | Rudell et al. | 473/575 |
| 5,797,812 | A | 8/1998 | Liu | |
| 6,319,158 | B1 * | 11/2001 | Cheng | 473/522 |
| 2006/0135296 | A1 * | 6/2006 | Lammer et al. | 473/520 |

FOREIGN PATENT DOCUMENTS

| | | |
|---|---|---|
| AT | 352 590 | 9/1979 |
| DE | 35 04 137 A1 | 8/1986 |
| EP | 0 497 561 A1 | 8/1992 |
| FR | 2 725 908 A1 | 4/1996 |
| JP | 60-168473 | 8/1985 |

* cited by examiner

*Primary Examiner*—Raleigh W. Chiu
(74) *Attorney, Agent, or Firm*—Finnegan, Henderson, Garabow, Garrett & Dunner, L.L.P.

(57) ABSTRACT

The present invention relates to a dampening device for a ball game racket, in particular a tennis, squash, racket ball or badminton racket, as well as to a ball game racket comprising a dampening device of this kind. The dampening device according to the invention comprises a base body made of foam material and a connecting means which is configured such that the dampening device can be fixed to at least one longitudinal string, preferably at least two longitudinal strings of a ball game racket without substantially coupling the embraced strings with each other.

23 Claims, 4 Drawing Sheets

DAMPENING DEVICE FOR A BALL GAMES RACKET

Figure 1:
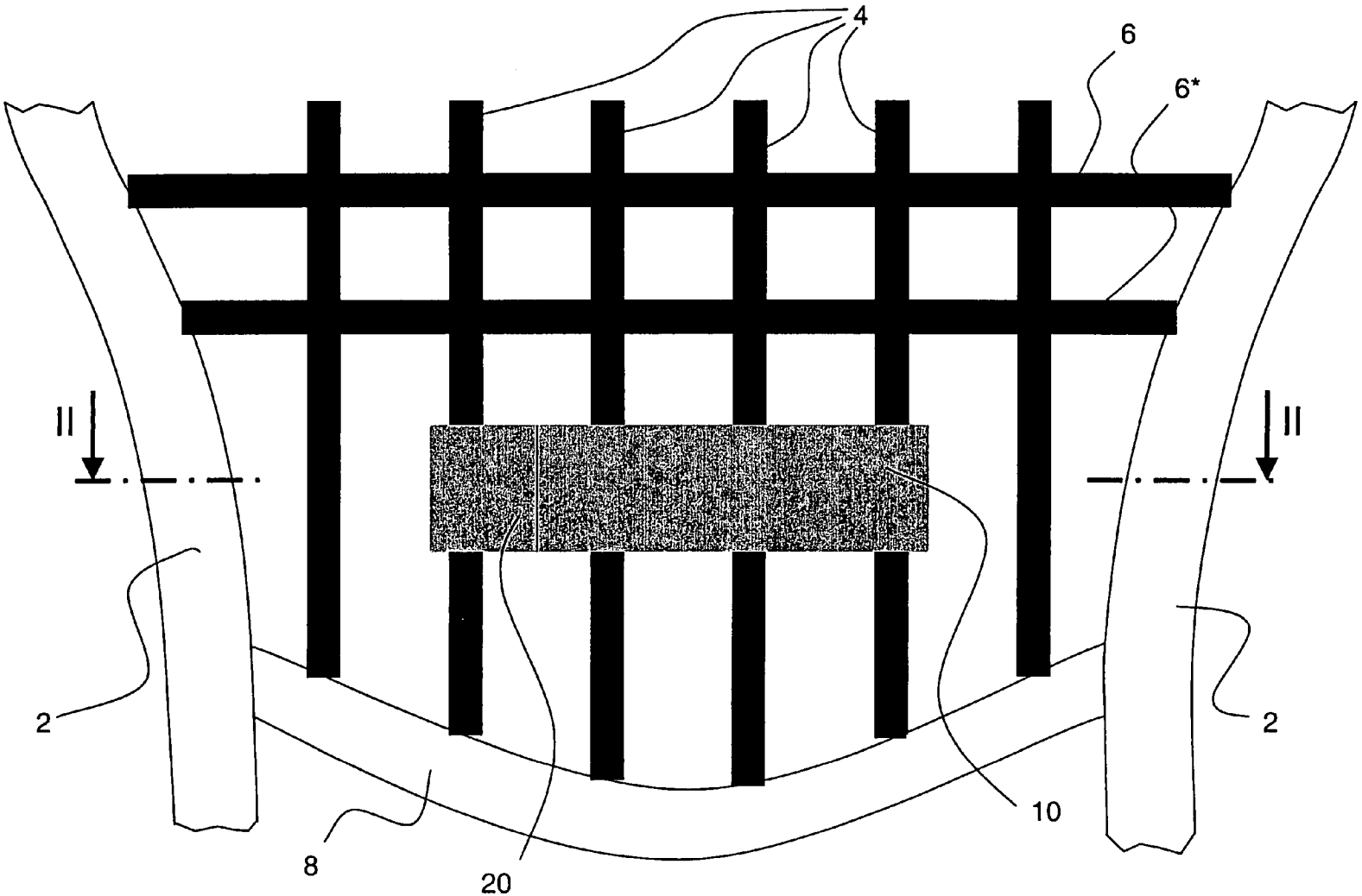

The present invention relates to a dampening device for ball game rackets, in particular tennis, squash, racket ball and badminton rackets, which can be fixed to the strings of the ball game racket. Moreover, the present invention relates to a ball game racket with a dampening device of this kind.

Dampening devices which are fixed to the strings of ball game rackets are in principle known. An example for a vibration absorber is described, for example, in AT-C 352 590 and the corresponding U.S. Pat. No. 4,180,265. This vibration absorber is formed such that the two middle longitudinal strings are connected to an elastomeric, viscoelastic vibration absorber at the end of the striking surface which is near the handle or the heart and outside the region of the transverse strings. This vibration absorber is designed to establish a force-transmitting connection to each of the longitudinal strings to be coupled. According to an embodiment, the vibration absorber therefore has two spaced-apart bores through which the longitudinal strings are threaded during the application of the strings to the racket. According to a further embodiment, the vibration absorber has a slot in its central region, wherein the vibration absorber is fitted on the desired neighboring longitudinal strings during application of the strings to the racket. The length of the slot is smaller than the distance between the strings to be covered. According to a further embodiment, the vibration absorber is essentially S-shaped so that two bearing surfaces for receiving the longitudinal strings are formed. According to this embodiment, the vibration absorber can be subsequently fitted on two neighboring strings of a previously strung racket. The dimension of the vibration absorber should be selected such that the two longitudinal strings to be coupled are urged toward each other owing to the fitting-on of the vibration absorber.

U.S. Pat. No. 4,732,383 describes a shock and vibration absorber for rackets, which is shaped as a bar and weaved over and under the vertical strings in a region between the handle and the nearest transverse string. This absorber extends along the entire width of the racket in this region, wherein the ends are fixed in the spaces between the frame and the nearest longitudinal strings. The bar-shaped absorber is composed of a plurality of layers of a shock-and-frequency absorbing material being soft, light and resilient. Also in this dampening device the longitudinal strings are coupled by means of the absorber.

Further dampening devices in which the strings are coupled with each other are disclosed, for example, in U.S. Pat. Nos. 4,776,590, 4,190,249, EP-A-0 261 994, EP-A-0 497 561, EP-A-0 642 811, JP-A-03231689, WO-A-88/02271 and WO-A-90/09215. These known dampening devices are unsatisfactory with respect to their dampening properties, their fitting-on requirements and/or their relatively complicated and thus expensive production.

It is an object of the present invention to provide an improved dampening device and an improved ball game racket, wherein in particular the disadvantages of the known devices should be overcome. This object is achieved with the features of the claims.

In achieving this object, the invention starts out from the basic idea of constructing a dampening or cushioning device as a preferably longitudinal base body made of a foam material, so that the dampening device can be fixed to at least one longitudinal string of the ball game racket by means of a connecting means. Preferably, the dampening device is configured such that it can be fixed to at least two, more preferably four longitudinal strings of a ball game racket by means of the connecting means without substantially coupling the embraced strings with each other.

The base body can be configured as one part so that it forms a ring or loop when embracing the strings, or the base body can consist of several parts, in particular two parts, wherein the two parts preferably face each other and embrace the strings after having been closed.

The connecting means is preferably provided on an entire side of the base body or on portions thereof. In order to allow the dampening device to be reused, the connecting means can preferably be opened and closed again. In particular, the connecting means can be configured as an adhesive layer, preferably as a releasable and/or repositionable adhesive layer, wherein the dampening device embraces the strings with its tacky side facing the strings. As an alternative or in addition thereto, the connecting means can be formed as a mechanical closure, for example in the form of a hook and loop closure. In this connection, it is particularly preferred to configure the closure elements of the mechanical connecting means such that they can engage themselves (e.g. mushroom-shaped hook elements). However, it is also possible to provide a first element of the mechanical closure at a portion or a base body element of the base body and a second element of the mechanical closure at a second portion or second base body element, wherein the two closure elements can be engaged with each other. For example, a first portion or base body element could comprise hooks which can be engaged with loops of the second portion or base body element.

The foam material of the base body is preferably an open-cell or closed-cell foam. The foam material of the base material preferably has a bulk density between 10 and 1000 kg/m$^3$ and more preferably between 100 and 500 kg/m$^3$. The thermal conductivity of the foam material preferably lies between 0.03 and 0.05 W/mK. Examples of foam materials which are suitable for being used as the base body of the dampening device of the present invention are, i.a., polystyrene, polyvinyl chloride, polyethylene, polyurethane, urea formaldehyde, phenol formaldehyde, epoxy resin and silicone.

The ball game racket of the present invention, in particular tennis, squash, racket ball or badminton racket, has strings comprising longitudinal and transverse strings, wherein the dampening device is fixed to at least one, preferably at least two, more preferably four of the longitudinal strings. The embraced strains are not substantially coupled with each other. The dampening device is preferably fixed to the longitudinal strings in a region outside the transverse strings, in particular in a region between the heart region of the ball game racket and the transverse string being closest to the heart region. According to a preferred embodiment of the ball game racket of the present invention, the dampening device is provided in the region of the longest longitudinal string and/or embraces four neighboring longitudinal strings. The dampening device embraces the longitudinal strings preferably in a relatively loose manner.

A ball game racket comprising the dampening device of the present invention surprisingly exhibits particularly advantageous dampening or attenuation characteristics being pleasant to the player, can be handled very well and is vibration-preventing, wherein at the same time the racket makes a pleasant sound although in its simplest embodiment the dampening device is fixed to only one single string. These properties of the ball game racket of the present invention come to light even more advantageously if the dampening device is provided on at least two, preferably on four of the longitudinal strings of the racket. Moreover, the dampening device is constructed simple manner so that the production costs are low and the dampening device can be fixed easily.

Figure 2A:
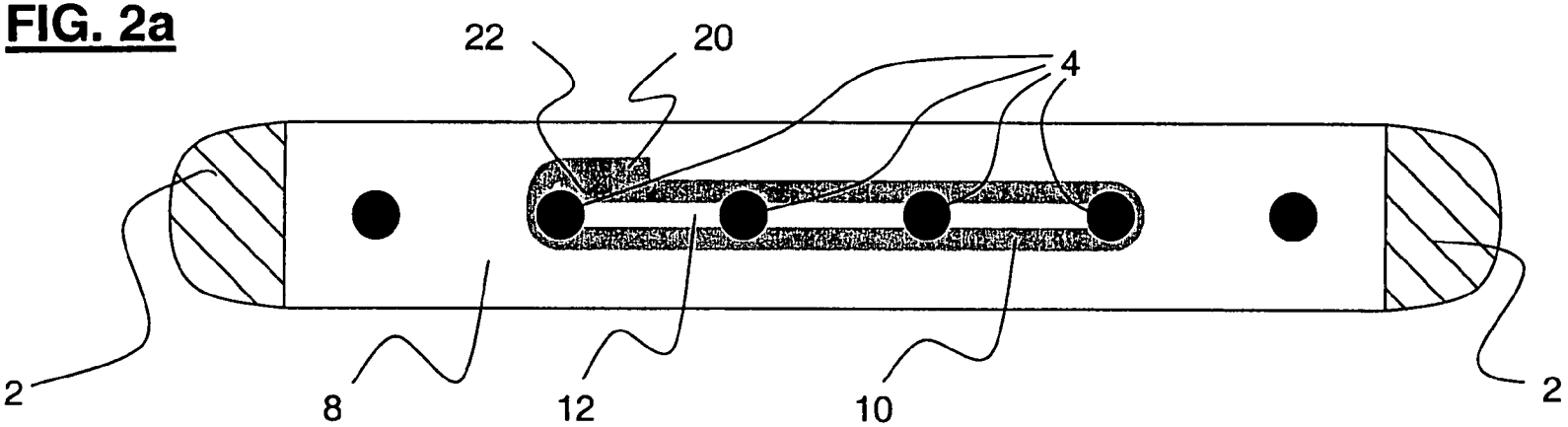
Figure 2B:
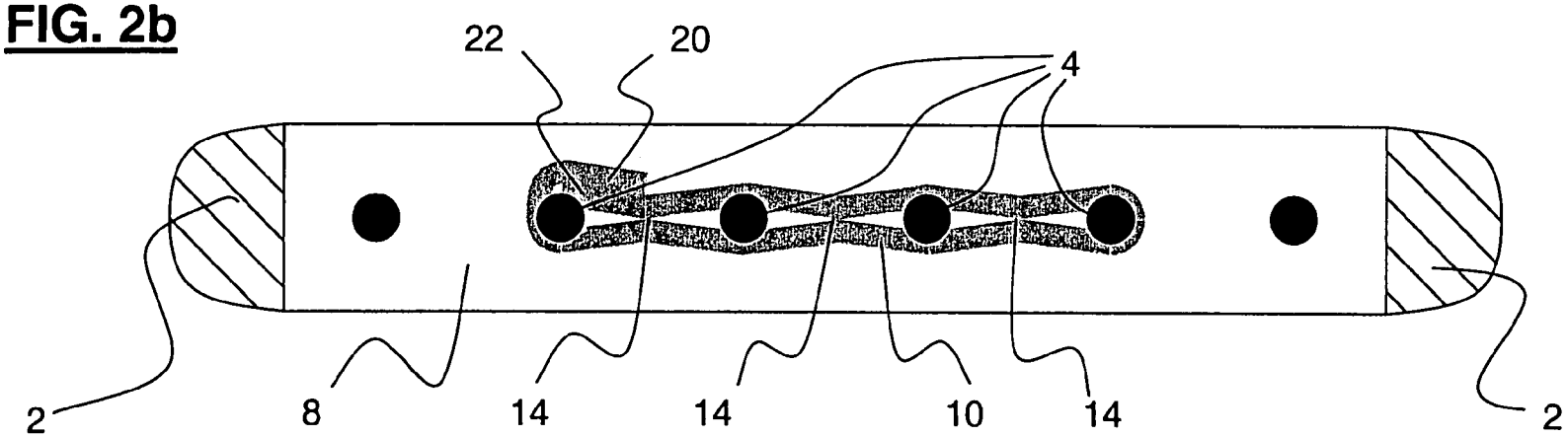
Figure 3A:
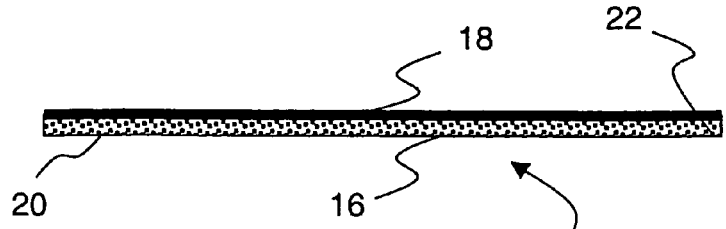
Figure 3B:
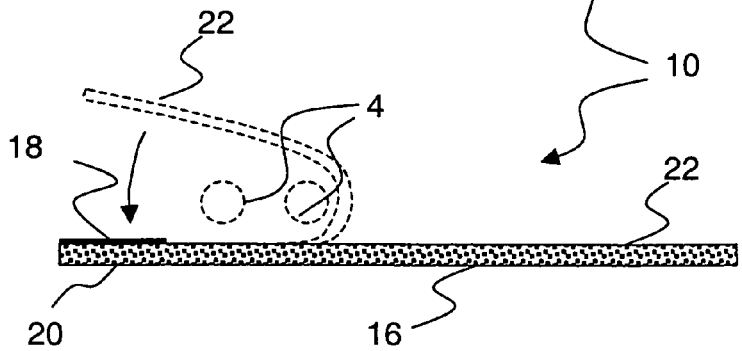
Figure 4A:
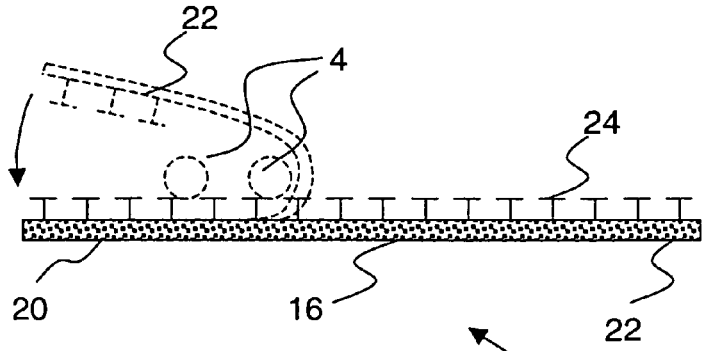
Figure 4B:
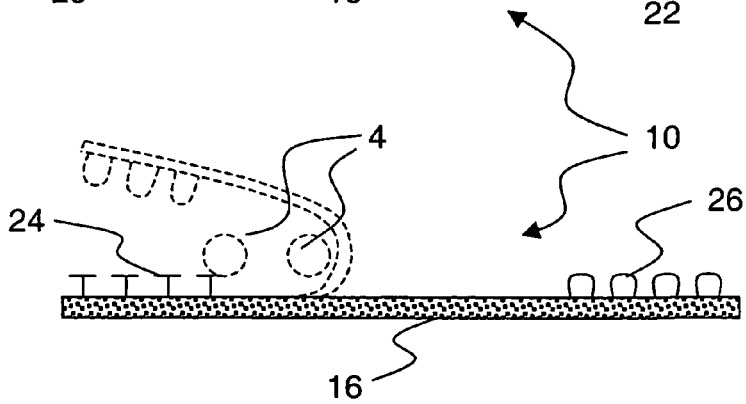
Figure 5A:
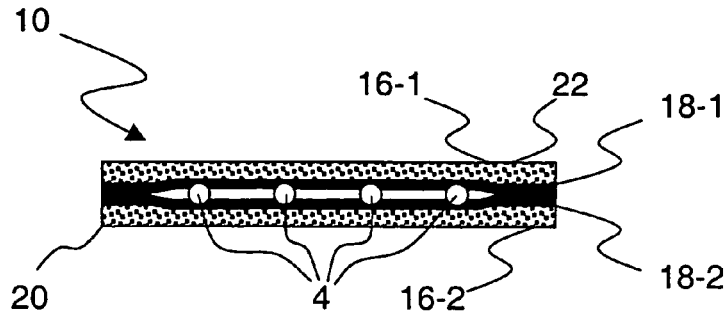
Figure 5B:
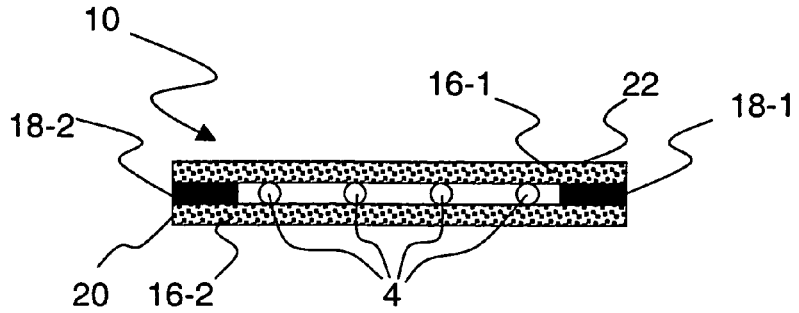
Figure 6A:
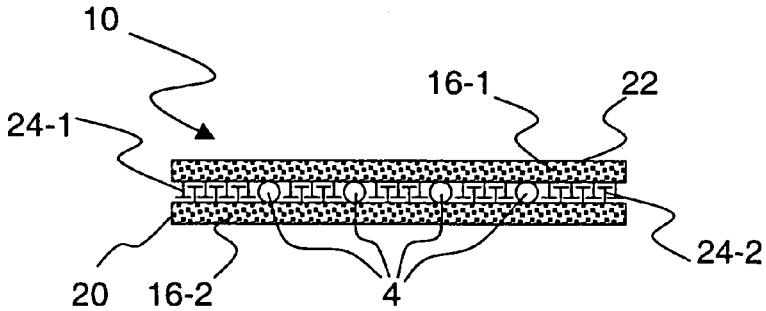
Figure 6B:
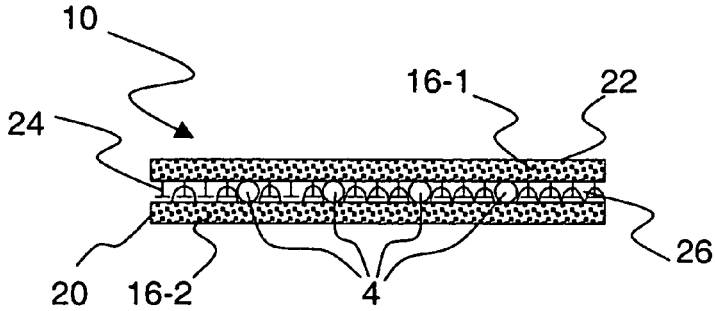

Preferred embodiments of the dampening device according to the invention and the ball game racket according to the invention are exemplarily described in the following on the basis of the drawings in which FIG. 1 is a partial top view of a ball game racket according to the invention with a dampening device according to the invention fixed to the strings;

FIG. 2*a* is a cross-sectional view along the line II-II of FIG. 1 in which a first way of fixing the dampening device according to the invention is shown;

FIG. 2*b* is a cross-sectional view along the line II-II of FIG. 1 in which a second way of fixing the dampening device according to the invention is shown;

FIGS. 3*a* and 3*b* are schematic representations of a first embodiment of the dampening device according to the invention;

FIGS. 4*a* and 4*b* are schematic representations of a second embodiment of the dampening device according to the invention;

FIGS. 5*a* and 5*b* are schematic representations of a third embodiment of the dampening device according to the invention;

FIGS. 6*a* and 6*b* are schematic representations of a fourth embodiment of the dampening device according to the invention.

FIG. 1 schematically shows a portion of the ball game racket according to the invention. The ball game racket essentially comprises a frame 2 as well as strings comprising longitudinal strings 4 and transverse strings 6. The frame 2 of the racket in principle comprises a handle portion (not shown) and a head portion (not shown either) with a heart portion therebetween. A part of the heart portion is suggested by the connecting web 8 shown in FIG. 1.

At least one dampening device 10 according to the invention is provided in the portion between the lowermost transverse string 6* and the heart portion 8 of the racket. According to the representation in FIG. 1, the dampening device 10 is fixed to four neighboring longitudinal strings 4 of the ball game racket strings.

In FIGS. 2*a* and 2*b*, the dampening device 10 is wound around four neighboring longitudinal strings 4. The longitudinal strings 4 are substantially not coupled with each other by the dampening device according to the invention. As shown in FIG. 2*a*, the dampening device 10 according to the invention embraces the longitudinal strings 4, wherein in the area between the individual longitudinal strings 4, the dampening device leaves open a gap-shaped passage 12, i.e. the two opposite portions of the dampening device 10 do not contact each other. In contrast thereto, in the embodiment schematically shown in FIG. 2*b*, the dampening device is arranged at the longitudinal strings 4 of the racket in such a manner that at least between some of the longitudinal strings the opposite portions of the dampening device contact each other at contact points 14 and are connected with each other at these points; nevertheless, the longitudinal strings 4 are not substantially coupled with each other.

FIGS. 3*a* and 3*b* show a first basic embodiment of the dampening device 10 according to the invention in more detail. The dampening device 10 essentially comprises a tape-shaped or elongate base body 16 and a connecting means 18. The base body 16 is made of a foam material, preferably an open-cell or closed-cell foam. A preferred foam material has a bulk density between 10 and 1000 kg/m$^3$, preferably between 100 and 500 kg/m$^3$. Moreover, suitable foam materials preferably have a thermal conductivity between 0.03 and 0.05 W/mK. Typically suitable foam materials are, for example, polystyrene, polyvinyl chloride, polyethylene, polyurethane, urea formaldehyde, phenol formaldehyde, epoxy resin or silicone.

In the embodiment of the dampening device 10 shown in FIG. 3*a*, the connecting means 18 is formed on the base body 16 as a continuous adhesive layer 18. The adhesive layer 18 preferably comprises a releasable and/or repositionable adhesive, i.e. after having been adhered by means of the adhesive layer 18, the dampening device 10 can be removed without leaving any essential residual adhesive and, in case of a repositionable adhesive, it can be adhered again. For example, a pressure-sensitive adhesive is suitable for this purpose.

In accordance with a preferred embodiment, a lining material or liner (not shown) is provided on the adhesive layer 18 of the dampening device according to the invention before the dampening device is fixed to the ball game racket in order to cover and protect the adhesive layer 18.

For fixing the dampening device shown in FIG. 3*a* to a ball game racket, the adhesive layer 18 is first released, for example by removing the liner. The dampening device is then wound around the desired longitudinal strings 4 of the ball game racket in accordance with the representations of FIGS. 2*a* and 2*b*, wherein the adhesive layer 18 is facing the strings. For closing the dampening device 10 or fixing it at the racket, either a first end portion 20 of the dampening device 10 is adhered in an overlapping manner on a second end portion 22 of the dampening device by means of the adhesive layer 18 in order to form a flat ring, or the two end portions are adhered to each other by means of the adhesive layer 18 in order to form a loop.

FIG. 3*b* shows a modification of this first embodiment of the dampening device 10 according to the invention in which the adhesive layer 18 is provided only on portions, preferably only on the end portion 20 of a side of the base body 16. For fixing the dampening device 10 according to FIG. 3*b*, one of the end portions, for example the second end portion 22, is threaded through a space between two neighboring longitudinal strings and wound around at least to neighboring longitudinal strings 4 in the direction towards the other end portion 20 and connected therewith by means of the adhesive layer 18. Similar to the embodiment according to FIG. 3*a*, there are in principle two possibilities. The adhesive layer 18 is either fixed to the outer side or the inner side of its opposite end portion 22. In case the end portion 20 is fixed to the outer side, a flat ring is formed in accordance with the representations shown in FIGS. 2*a* and 2*b*, while when fixing the adhesive layer 18 to the inner side of the opposite end 22, a loop is formed in accordance with the dashed variant of FIG. 3*b*, wherein the longitudinal strings 4 are embraced by the formed loop.

FIGS. 4*a* and 4*b* show a second basic embodiment of the dampening device according to the invention, wherein the connecting device is formed as a mechanical closure. In particular, the mechanical closure can be configured as a so-called hook and loop closure. In the embodiment shown in FIG. 4*a*, the mechanical closure is essentially formed of identical, preferably mushroom-shaped hook elements so that they can engage each other. The hook-shaped closure elements 24 extend either only on portions of or preferably continuously along one side of the base body 16. In a similar manner as described above with reference to FIG. 3*b* and shown by the arrow in FIG. 4*a*, the dampening device 10 can be closed on the longitudinal strings 4 of a ball game racket by forming a loop embracing at least two longitudinal strings 4, as shown in FIG. 4*a* in dashed lines. In accordance with the invention, the strings 4 embraced by the dampening device 10 are not substantially coupled with each other.

The modification of the second embodiment of the dampening device 10 according to the invention shown in FIG. 4*b* in principle corresponds to that shown in FIG. 4*a*, wherein a first portion of the mechanical closure is formed of hook-shaped closure elements 24 and a second portion of the mechanical closure is formed of loops 26. When closing the dampening device 10, the hooks 24 engage the loops 26 and thus provide a connecting means. In contrast to the embodiment shown in FIG. 4*b*, the loops 26 do not necessarily have to be closed loops but they can also be partial arcs which can be engaged with the hooks 24.

The third basic embodiment of the dampening device 10 according to the invention shown in FIGS. 5*a* and 5*b* essentially corresponds to the respective embodiments shown in FIGS. 3*a* and 3*b*, wherein the base body 16 consists of two parts and comprises a first body part 16-1 and a second body part 16-2. At least one of the base body parts 16-1 or 16-2 is provided with a connecting means in the form of an adhesive layer 18. In the shown representation, both base body parts have an adhesive layer 18-1 and 18-2. For fixing the dampening device 10 to the longitudinal strings 4 of a ball game racket in accordance with FIG. 5*a*, first the first base body part 16-1 is placed on the longitudinal strings 4 so that its adhesive layer 18-1 faces the longitudinal strings 4, and then the second base body part 16-2 is placed with its adhesive layer 18-2 on the opposite sides of the longitudinal strings and the first base body part 16-1, so that the two base body parts 16-1 and 16-2 can be connected with each other at least in the area of their end portions 20 and 22 by means of the adhesive layer 18-1 and/or 18-2. A connection in the intermediate area between the strings 4 is also possible. The second base body part 16-2 does not necessarily have to have an adhesive layer 18-2.

The modification of the third embodiment shown in FIG. 5*b* essentially corresponds to that shown in FIG. 5*a*, wherein the first base body part 16-1, for example, has an adhesive layer 18-1 on its end portion 22 and the second base body part 16-2 has an adhesive layer 18-2 on its end portion 20. The dampening device 10 according to FIG. 5*b* is fixed in the same manner as described with reference to FIG. 5*a*.

FIG. 6*a* shows a fourth basic embodiment of the dampening device 10 according to the invention; it consists of a first base body part 16-1 and a second base body part 16-2 and a connecting means in the form of engageable hook elements 24 corresponding to the description of the embodiment shown in FIG. 4*a*. The dampening device 10 according to FIG. 6*a* is fixed to the longitudinal strings of a ball game racket in a manner similar to that described in connection with FIGS. 5*a* and 5*b*, wherein the hook elements 24-1 of the first base body part 16-1 are engaged with the hook elements 24-2 of the second base body part 16-2.

The embodiment shown in FIG. 6*b* is a modification of the fourth embodiment of the dampening device according to the invention as shown in FIG. 6*a*, wherein the mechanical closure is formed of hook elements 24 and loop elements 26, as already described with reference to the embodiment shown in FIG. 4*b*. However, in this embodiment the dampening device according to the invention comprises a base body consisting of a first base body part 16-1 with hook elements 24 and a second base body part 16-2 with loops 26. The dampening device according to FIG. 6*b* is fixed in the same way as described above, namely by engaging the two elements of the connecting means thereby enclosing the longitudinal strings 4.

As a modification of the embodiments of the shown dampening device comprising a base body having a rectangular cross-section, the cross-section of the base body can also have different shapes. For example, the base body could have a triangular, semi-circular or trapezoidal cross-section. Moreover, the base body does not have to be tape-shaped or elongate but it can also have different shapes (in the top view), for example square, circular, figure-eight-shaped, oval, etc.

Both the mechanical connecting means and the connecting means formed by the adhesive layer(s) can be provided on portions of or on a complete side of the base body or base body parts.

The dampening device according to the invention is advantageous in that it can be produced and fixed to the strings of a ball game racket easily, wherein it is preferably reusable and exhibits particularly advantageous dampening or absorption characteristics. Moreover, the sound caused when the ball is struck by means of the ball game racket is influenced in a particularly advantageous manner in that a relatively dull or sonorous "plong" is caused.

The invention claimed is:

1. A dampening device for ball game rackets comprising a base body made of foam material and a connector formed such that the dampening device can be fixed to at least two longitudinal strings of a ball game racket, the dampening device being configured to embrace opposing sides of each of the at least two longitudinal strings without fully enclosing each of the at least two longitudinal strings, and the base body comprising two parts, wherein the two parts can be fixed opposite each other in such a way that the at least two longitudinal strings are enclosed between the two parts.

2. The dampening device according to claim 1, which is configured such that the dampening device can be fixed to four longitudinal strings of the racket.

3. The dampening device according to claim 1, wherein the base body is elongate or tape-shaped.

4. The dampening device according to claim 1, wherein the connector is provided on a side of the base body.

5. The dampening device according to claim 1, which is reusable in that the connector can be reopened.

6. The dampening device according to claim 1, wherein the connector is formed as an adhesive layer provided on the base body.

7. The dampening device according to claim 6, wherein the adhesive layer is releasable, repositionable, or releasable and repositionable.

8. The dampening device according to claim 1, wherein the connector is formed as a mechanical closure.

9. The dampening device according to claim 8, wherein a first base body part comprises a first part of the mechanical closure and a second base body part comprises a second part of the mechanical closure which are engageable with each other.

10. The dampening device according to claim 8, wherein the mechanical closure extends essentially along the entire length of the base body and comprises essentially identical hook elements that are engageable with each other.

11. The dampening device according to claim 8, wherein mechanical closure is a hook and loop closure.

12. The dampening device according to claim 1, wherein at least one of the base body parts comprises an adhesive layer for a connection with the other base body part.

13. The dampening device according to claim 1, wherein the foam material of the base body is made of open-cell or closed-cell foam.

14. The dampening device according to claim 1, wherein the foam material of the base body has a bulk density between 10 and 1000 kg/m$^3$.

15. The dampening device according to claim 14, wherein the foam material of the base body has a bulk density between 100 and 500 $kg/m^3$.

16. The dampening device according to claim 1, wherein the foam material of the base body has a thermal conductivity between 0.03 and 0.05 W/mK.

17. The dampening device according to claim 1, wherein the foam material of the base body comprises a material selected from the group consisting of polystyrene, polyvinyl chloride, polyethylene, polyurethane, urea formaldehyde, phenol formaldehyde, epoxy resin and silicone.

18. A ball game racket comprising at least one dampening device according to claim 1, wherein the ball game racket has strings comprising the at least two longitudinal strings and transverse strings and wherein the dampening device is fixed to the at least two of the longitudinal strings and embraces them relatively loosely.

19. The ball game racket according to claim 18, wherein the dampening device is fixed to the longitudinal strings in an area outside the transverse strings.

20. The ball game racket according to claim 18, wherein the dampening device is fixed to the longitudinal strings in an area between the heart portion of the racket and the transverse string closest to the heart portion.

21. The ball game racket according to claim 18, wherein the dampening device is provided in the area of the longitudinal strings that are longest.

22. The ball game racket according to claim 18, wherein the dampening device is fixed to at least two neighboring longitudinal strings.

23. The ball game racket according to claim 18, wherein the dampening device is fixed to four neighboring longitudinal strings.

* * * * *